US006871451B2

(12) United States Patent
Harger et al.

(10) Patent No.: US 6,871,451 B2
(45) Date of Patent: Mar. 29, 2005

(54) MULTIPOINT LOCK ASSEMBLY

(75) Inventors: James R. Harger, Rockford, IL (US); Todd K. Ellerton, Loves Park, IL (US); Christopher G. Walls, Rockford, IL (US)

(73) Assignee: Newell Operating Company, Freeport, IL (US)

( * ) Notice: Subject to any disclaimer, the term of this patent is extended or adjusted under 35 U.S.C. 154(b) by 64 days.

(21) Appl. No.: 10/107,518

(22) Filed: Mar. 27, 2002

(65) Prior Publication Data

US 2003/0185691 A1 Oct. 2, 2003

(51) Int. Cl.[7] ..... E05B 55/00
(52) U.S. Cl. ..... 49/449; 292/302
(58) Field of Search ..... 49/449; 292/300, 292/302, 32–43

(56) References Cited

U.S. PATENT DOCUMENTS 3,680,901 A * 8/1972 Biebuyck ..... 292/36
3,697,105 A * 10/1972 Marx ..... 292/216
3,811,717 A * 5/1974 Floyd et al. ..... 292/92
4,362,328 A * 12/1982 Tacheny et al. ..... 292/36
4,500,122 A 2/1985 Douglas
4,643,005 A 2/1987 Logas
4,648,639 A * 3/1987 Martin et al. ..... 292/167
4,674,776 A * 6/1987 James ..... 292/40
4,754,624 A 7/1988 Fleming et al.
4,861,078 A * 8/1989 Munoz ..... 292/113
4,865,367 A * 9/1989 Choi ..... 292/92
4,973,091 A 11/1990 Paulson et al.
4,974,886 A * 12/1990 Kleefeldt et al. ..... 292/201
5,096,237 A 3/1992 Hötzl
5,120,094 A 6/1992 Eaton et al.
5,290,077 A 3/1994 Fleming
5,388,875 A * 2/1995 Fleming ..... 292/37
5,394,718 A 3/1995 Hötzl
5,404,737 A 4/1995 Hötzl
5,419,597 A * 5/1995 Brackmann et al. ..... 292/201
5,440,103 A * 8/1995 Martin ..... 219/413
5,492,382 A * 2/1996 McBride et al. ..... 292/341.17
5,495,731 A 3/1996 Riznik
5,498,038 A * 3/1996 Simon et al. ..... 292/36
5,676,003 A * 10/1997 Ursel et al. ..... 70/472
5,722,704 A 3/1998 Chaput et al.
5,820,170 A 10/1998 Clancy
5,820,177 A 10/1998 Moon
5,873,274 A 2/1999 Sauerland
5,878,605 A 3/1999 Renz
5,906,403 A 5/1999 Bestler et al.
6,048,000 A * 4/2000 Geringer et al. ..... 292/92
6,209,364 B1 * 4/2001 Collet et al. ..... 70/107
6,209,931 B1 * 4/2001 Von Stoutenborough et al. ..... 292/160
6,357,803 B1 * 3/2002 Lorek ..... 292/99
6,539,755 B1 * 4/2003 Bruwer et al. ..... 70/107

* cited by examiner

*Primary Examiner*—Leslie A. Braun
*Assistant Examiner*—Khoa Tran
(74) *Attorney, Agent, or Firm*—Wallenstein Wagner & Rockey, Ltd.

(57) ABSTRACT

A locking system is disclosed for a moveable member supported by a support frame, the support frame having an engagement surface, the locking system comprising a lock member and an input device adapted to be mounted on the moveable member, the input device being operably connected to the lock member. The input device is rotatable to move the lock member from a first position to a second position, the second position defining a locked position wherein the lock member is adapted to be in contact with the engagement surface. The locking system also includes a link arm and a spring that permits additional rotation of the input shaft after the lock member reaches the locked position.

28 Claims, 13 Drawing Sheets

MULTIPOINT LOCK ASSEMBLY

TECHNICAL FIELD

This invention relates generally to a lock unit for a sliding sash. More particularly, it relates to a multipoint lock assembly for a sliding door or window sash.

BACKGROUND OF THE INVENTION

Various types of sliding door or window assemblies are well known in the art. For example, a typical sliding door assembly may be used in a residential setting such as for a patio door. Such sliding door assemblies typically include two door sashes mounted within a master frame. One door sash may be stationary or remain in a fixed position relative to the master frame. The other door sash may typically be slidably mounted within the master frame. Alternatively, one or both of the door sashes can be hingedly connected to the master frame to be swinging doors.

A variety of types of locking mechanisms have typically been provided for these sliding door assemblies. A simple single point lock mechanism has been provided that includes a finger that engages a keeper on the door frame, holding the door in a closed position. This type of lock is simple to manufacture and simple to operate. However, it provides only a limited measure of security and can be relatively easily overcome in a forcible entry.

Multipoint lock assemblies are also known in the art. Typically, these assemblies include a plurality of keepers mounted to the frame. They also include a lock unit that mounts to an edge of the sliding door sash. The lock unit includes a corresponding plurality of latch members and a latch actuation unit. When the door is closed, the latch actuation unit is used to cause the latch members to engage the keepers, thereby preventing the door from being opened.

A disadvantage of known multipoint lock assemblies is that they are often complicated making them expensive and difficult to manufacture. They often include complicated lock actuators, latches and keepers. They also typically include complicated link mechanisms between moving parts along their lengths.

A further disadvantage is that multipoint lock assemblies require precise alignment between each keeper and its corresponding latch member. This alignment must be made at the time of installation and maintained through the life of the lock assembly. If proper alignment is not achieved or maintained, the lock assembly will not function properly. Misalignment may result in an inability of the latch mechanisms to engage the keepers or to be placed and maintained in a positively locked position. Misalignment may also result in damage to the latches or other components.

A further disadvantage is that past lock units have been able to be activated while the door is in an open position. This places the latches in an engaged position while the latches are at a distance from the keepers. If the door is then closed before moving the latches back to an open or unlocked position, damage can result to the keepers, the latches or other aspects of the lock unit.

A further disadvantage is that typical multipoint lock units and their actuators cannot accommodate for misalignment that may occur over the course of time throughout the life of the unit.

A further disadvantage is that the latch members of the lock units are not typically as sturdy or strong as one would desire to ensure an appropriate measure of security.

The present invention is provided to solve these and other problems.

SUMMARY OF THE INVENTION

The present invention provides a multipoint lock assembly for a door assembly or window assembly. The door or window assembly has a movable member such as a door or window sash supported by a support frame.

According to a first aspect of the invention, a locking system for a moveable member supported by a support frame is provided, the support frame having an engagement surface. The locking system includes a lock member and an input device adapted to be mounted on the moveable member, the input device being operably connected to the lock member. The input device is rotatable to move the lock member from a first position to a second position, the second position defining a locked position wherein the lock member is adapted to be in contact with the engagement surface. Also according to a first aspect of the invention, means for allowing additional rotation of the input shaft after the lock member reaches the locked position is provided.

According to another aspect of the invention, the means for allowing additional rotation includes an elastic connection between the lock member and the input device.

According to another aspect of the invention, the means for allowing additional rotation includes a link arm connected between the input device and lock member, the link arm being slideable relative to the lock member when the lock member is in the locked position.

According to another aspect of the invention, the means for allowing additional rotation includes a spring having one end connected to the input device and another end connected to the lock member.

According to another aspect of the invention, the means for allowing additional rotation allows the input device to rotate to a position defining a locked position.

According to another aspect of the invention, a locking system for a door movably mounted in a door frame is provided, the door frame having an engagement surface. The locking system includes an input device adapted to be mounted on the door and rotatable from a first position to a second position and a link arm having a first end and a second end, the first end being connected to the input device. A lock member having a lock surface is also provided, the lock member being associated with the link arm. A spring is provided having a first end connected to the link arm and a second end connected to the lock member, wherein the link arm and spring move the lock member in response to rotational movement of the input device from the first position to an intermediate position wherein the lock member moves from an unlocked position to a locked position, wherein the lock surface contacts the engagement surface, wherein the operable connection between the link arm and lock member allows the link arm to move relative to the lock member to allow the input device to be further rotated to the second position.

According to another aspect of the invention, the second end of the link arm has a slot therein and the locking member has a pin being received by the slot.

According to another aspect of the invention, the second end of the spring is connected to the pin.

According to another aspect of the invention, the locking system includes a latch mounted to the door frame defining the engagement surface and an aperture defining the lock surface wherein the aperture receives the latch.

According to another aspect of the invention, the locking system includes an upper extension operably connected to the lock member, the upper extension having an upper lock surface, wherein the link arm and spring move the upper extension in response to rotational movement of the input device from the first position to the intermediate position wherein the upper lock surface contacts an upper engagement surface of the door frame.

According to another aspect of the invention, the locking system the operable connection between the link arm and lock member allows the link arm to move relative to the lock member to allow the input device to be further rotated to the second position after the upper lock surface contacts the upper engagement surface.

According to another aspect of the invention, the locking system also includes an upper latch mounted to the door frame defining the upper engagement surface and an upper aperture defining the upper lock surface wherein the upper aperture receives the upper latch.

According to another aspect of the invention, the locking system also includes a lower extension operably connected to the lock member, the lower extension having a lower lock surface wherein the link arm and spring move the lower extension in response to rotational movement of the input device from the first position to the intermediate position wherein the lower lock surface contacts a lower engagement surface of the door frame.

According to another aspect of the invention, the operable connection between the link arm and lock member allows the link arm to move relative to the lock member to allow the input device to be further rotated to the second position after the lower lock surface contacts the lower engagement surface.

According to another aspect of the invention, the locking system also includes a lower latch mounted to the door frame defining the lower engagement surface and a lower aperture defining the lower lock surface wherein the lower aperture receives the latch.

According to another aspect of the invention, the input device further comprises a shaft and the link arm further comprises a hook formed from the first end of the link arm, wherein the hook is biased to receive the shaft when the input device is in the second position.

According to another aspect of the invention, the lock member has u-shaped cross section.

Other features and advantages of the invention will be apparent from the following specification taken in conjunction with the following drawings.

BRIEF DESCRIPTION OF THE DRAWINGS

The multipoint lock assembly of the invention will now be described with reference to the accompanying drawings, in which.

DETAILED DESCRIPTION

Figure 1:
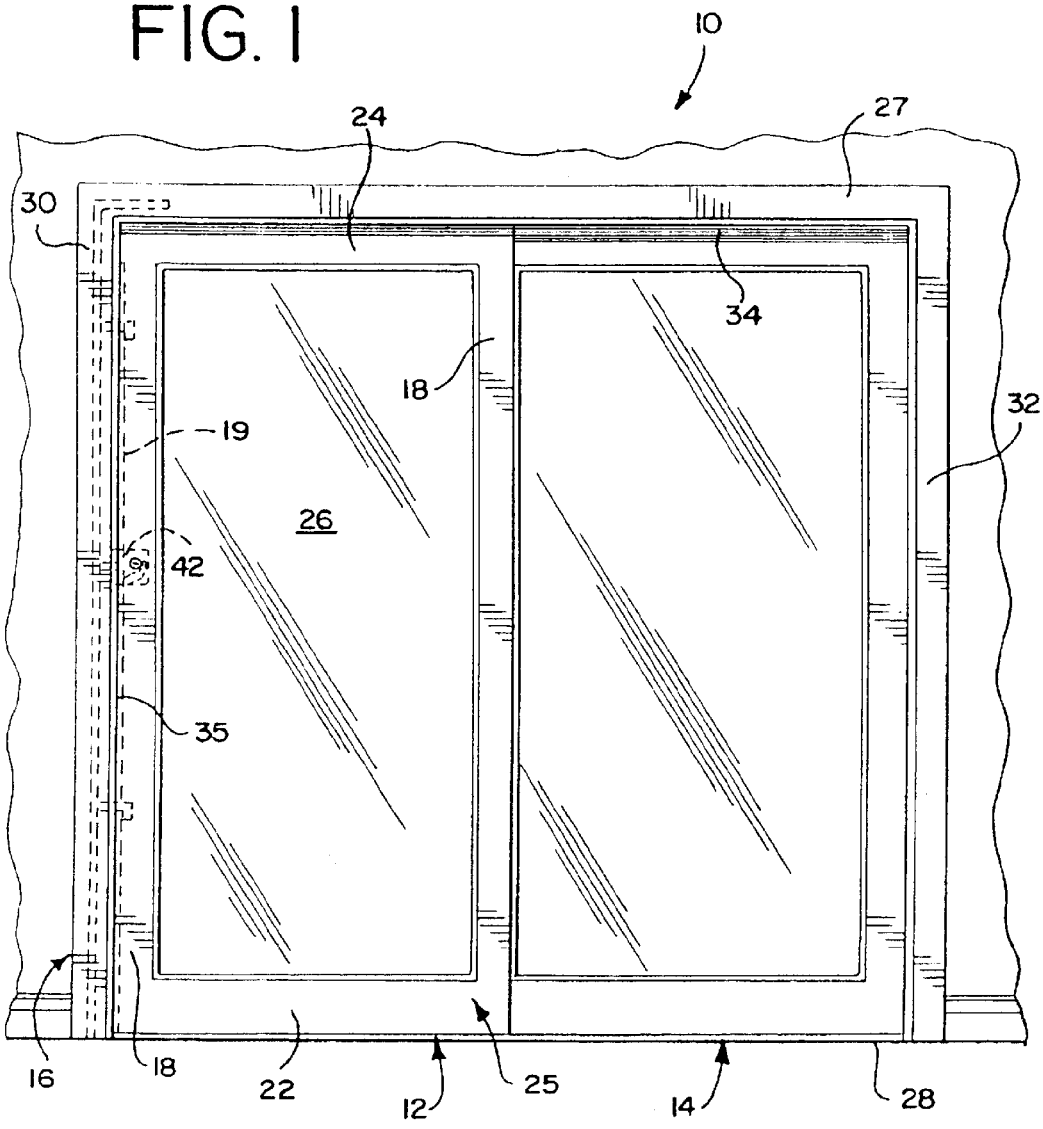
FIG. 1 is an elevation of a sliding door assembly having a multi-point lock assembly of the present invention shown in phantom.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a sliding door assembly 10 having a sliding panel 12 and a fixed panel 14 mounted within a master door frame 16. A lock assembly 42 of the present invention is shown in phantom. The sliding panel 12 is adapted for reciprocal sliding movement within the master frame 16. The fixed panel 14 remains stationary with respect to the master frame 16 and is fixed thereto. The sliding panel 12 can be considered a movable member and the door frame 16 can be considered a support frame.

The sliding panel 12 includes a pair of vertical stiles 18, and a pair of horizontal members 22 and 24 that cooperate to form a frame 25. A glass pane 26 is fitted within the frame 25. It is understood that the invention may be equally used with panels 12, 14 that are solid, rather than including a glass pane 26. The master frame 16 includes a horizontal header 27, horizontal footer 28, a left jamb 30 and a right jamb 32. An upper track 34 is mounted to or integrally formed in the horizontal header 26 and a lower track (not shown) is mounted to or integrally formed in the horizontal footer 28. A jamb channel 35 is mounted to or integrally formed in the left jamb 30. A recess 19 is formed into the edge of the vertical stile 18. While in a preferred embodiment, the door assembly 10 is a sliding door assembly, it is understood that the present invention can be configured to be installed in a swinging door assembly. It is further understood that the present invention can be incorporated into window assemblies or other applications having a movable member supported by a support frame.

Figure 2:
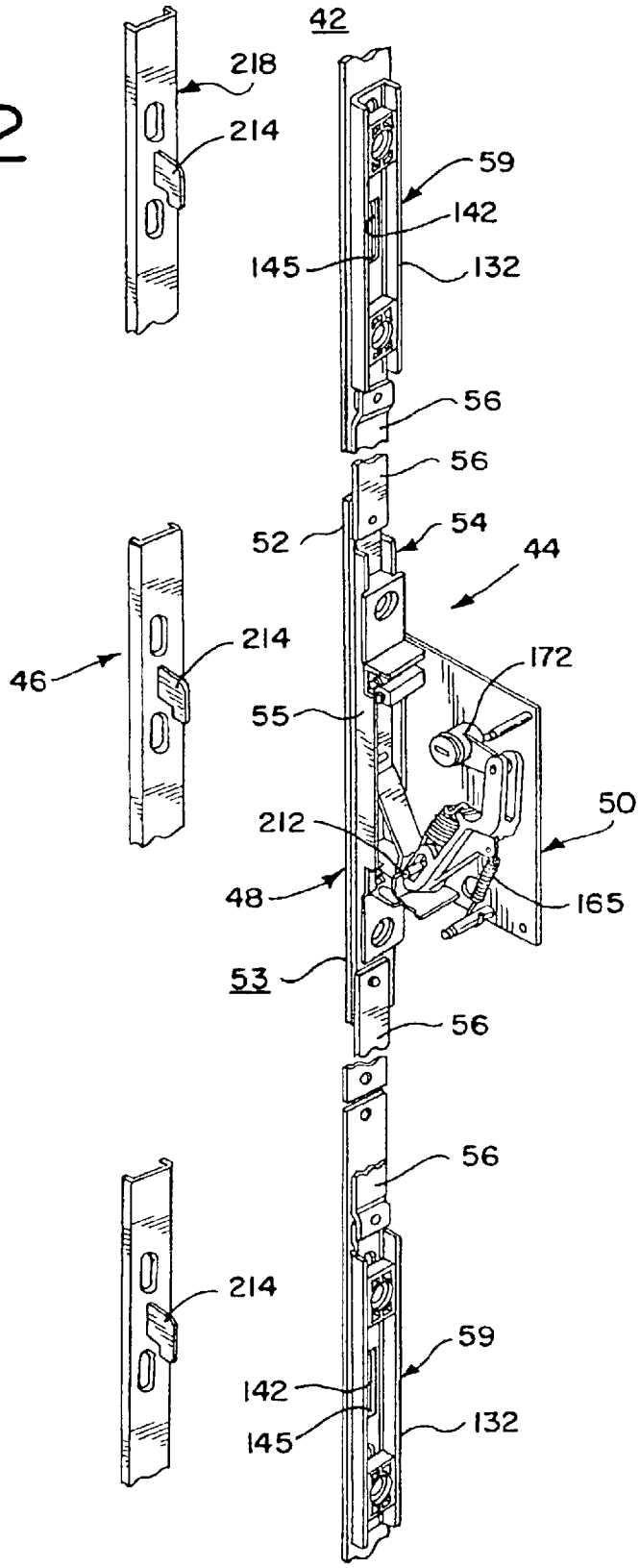
FIG. 2 is an isometric view of an embodiment of the multipoint lock assembly of the present invention.

The lock assembly 42 is comprised of a sliding lock unit 44 and a strike unit 46 (FIG. 2). As generally shown in FIG. 1, the sliding lock unit 44 is mounted to the sliding panel 12, partially within the vertical stile 18, as described in detail below. The strike unit 46 is mounted in the jamb channel 35, as described in detail below. In alternative embodiments, the sliding door assembly 10 may comprise at least two sliding panels 12. In this embodiment, the panels 12 slide towards each other to close the door assembly via abutting vertical stiles 18 of the respective panels 12. The lock assembly 42 secures the abutting stiles 18 to one another to prevent the panels 12 from being separated. Additional stationary panels may be associated with the sliding panels.

Figure 3:
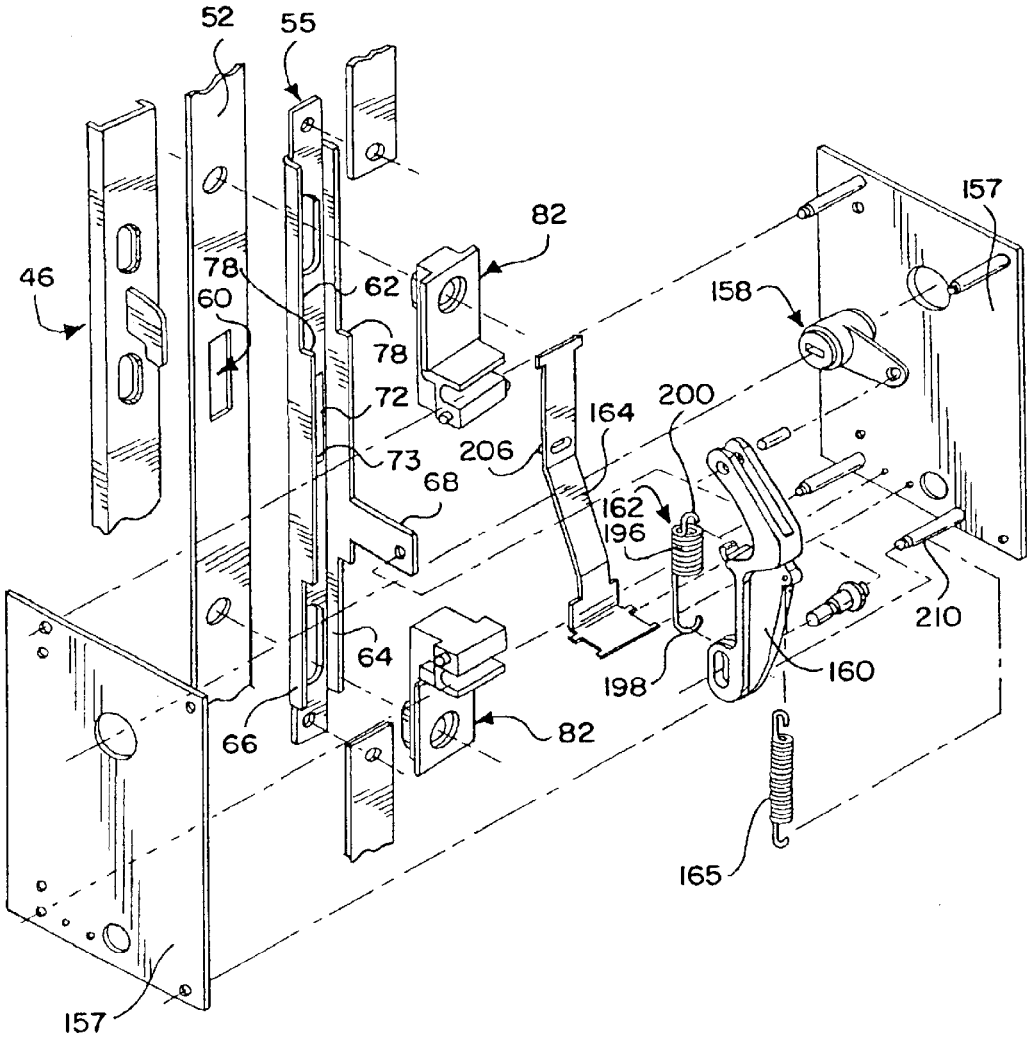
FIG. 3 is an exploded view of a lock actuator of a sliding lock unit of the multipoint lock assembly.

The sliding lock unit 44, as shown in FIGS. 2–3, includes a lock member assembly 48 and a lock actuator 50. The lock member assembly 48 includes a face plate 52, and a lock member 54.

The face plate 52 is formed from a piece of flat steel and has a centrally located aperture 60. The face plate 52 is sized to be mounted to an edge of the sliding panel 12.

Figure 4:
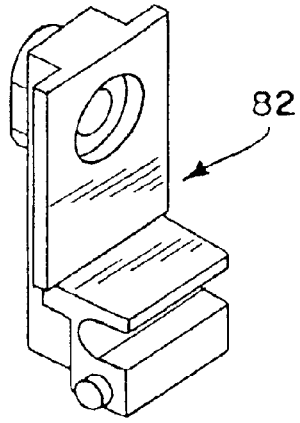
FIG. 4 is an isometric view of a case mount of the lock plate assembly.
Figure 5:
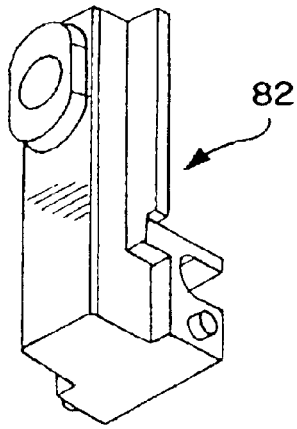
FIG. 5 is an isometric view of the case mount of FIG. 4 at a different angle of perspective than that of FIG. 4.
Figure 7:
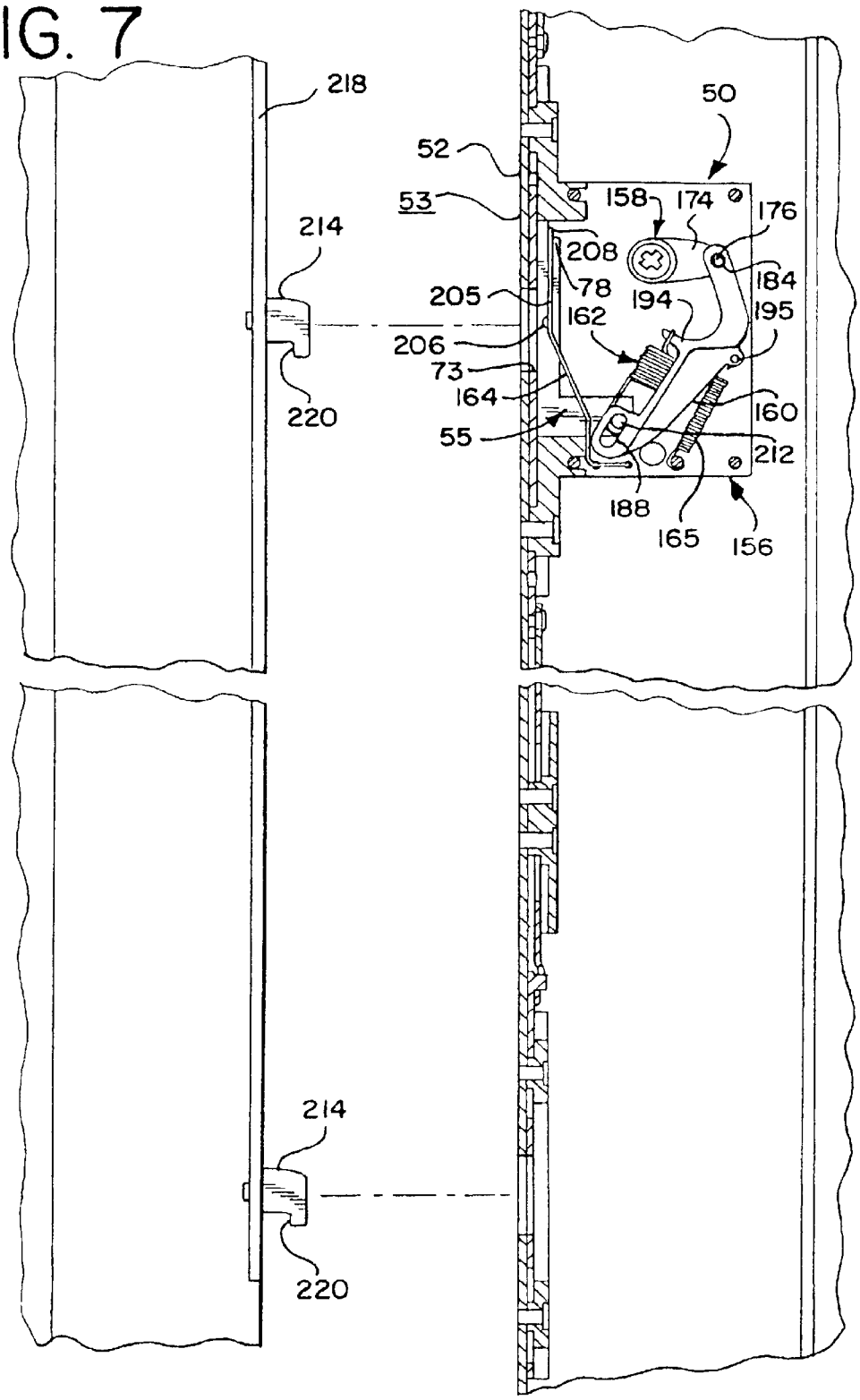
FIG. 7 is a partial side view of the lock assembly with a side plate of the lock actuator removed.

In a preferred embodiment, the lock member 54 includes a central portion 55 and a pair of extension assemblies 59. Furthermore, it is understood that the lock member 54 may include any number of extension assemblies 59. However, it is understood that the lock member 54 may be comprised of only the central portion 55 and remain within the scope of the invention. The central portion 55 has a base 62 having an aperture 72. The aperture 72 defines a lock surface 73 (FIG. 7). Extending generally perpendicularly from the base 62 is a first side wall 64 and a second side wall 66. The base 62, the first side wall 64 and the second side wall 66 combine to give the central portion 55 a generally U-shaped cross section. In alternative embodiments, the central portion 55 may have a generally flat cross section. The first side wall 64 includes a tab 68 and a safety notch 78. A pivot pin or post 212 extends from the tab 68. An additional safety notch 78 is located on the second side wall 66. The lock member 54 is slidably mounted to the face plate 52 via a pair of case mounts 82, as shown in FIGS. 3–5. Similarly, the extensions assemblies 59 may be integrally formed with the central portion 55 or the face plate 52.

Figure 6:
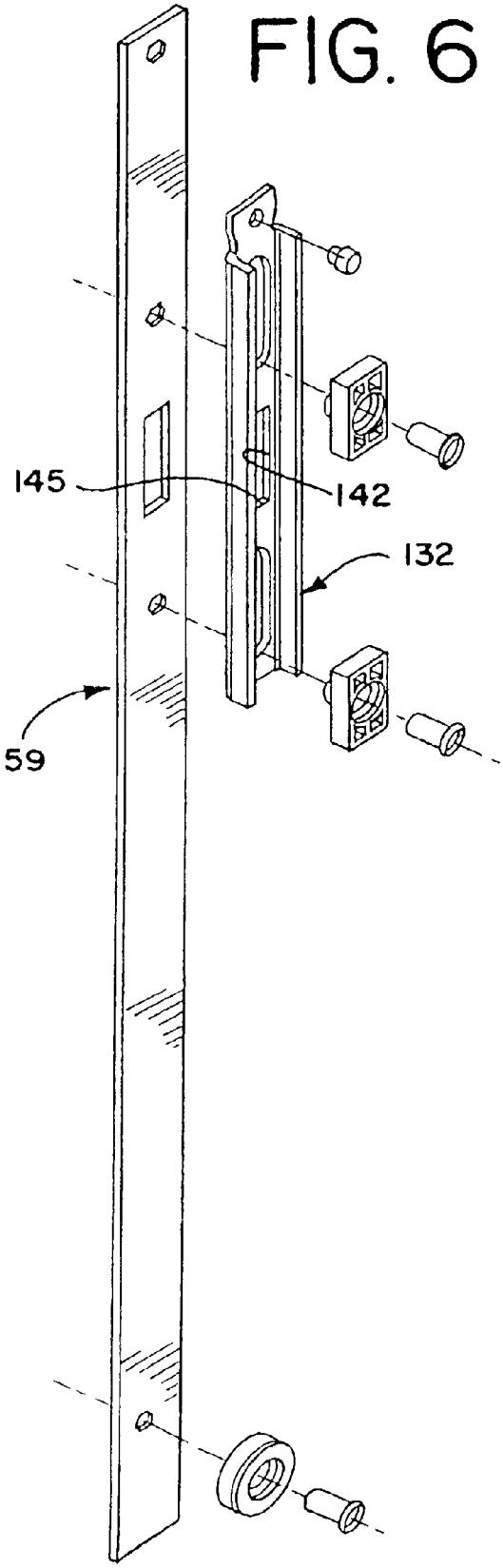
FIG. 6 is an exploded view of an extension assembly of the multipoint lock assembly.

Each extension assembly 59 is identical to the other. Therefore, only one extension assembly 59 is described. (FIGS. 2 and 6) The upper extension assembly 59 includes a drive arm 56 and an extension portion 132. However, it is understood that the upper extension 59 may include only the extension portion 132 while remaining within the scope of the invention. The extension portion 132 is generally U-shaped, similar to the U-shaped cross section of the central portion 55. It is understood that the extension portion 132 may have a flat cross section, as well. The extension portion 132 has an extension aperture 142 defining an extension lock surface 145. The drive arm 56 is formed from a flat piece of steel and is operably connected to both the central portion 55 and the extension portion 132, as shown. It is further understood that the extension assemblies 59 can vary in length.

Referring to FIGS. 2, 3 and 7, the lock actuator 50 of the sliding lock unit 44 includes a housing 156, an input device 158, a link arm 160, an overcenter spring 162, a safety spring, or actuation or deflectable member 164 and a return spring 165. The housing 156 includes a pair of side plates 157 attached to one another via four pins 210.

Figure 8:
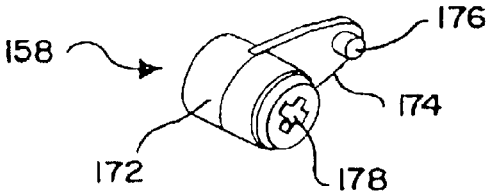
FIG. 8 is an isometric view of an input device of the lock actuator.

The input device 158 is rotatably mounted to the housing 156 and has a generally cylindrical shaft 172, as shown in FIGS. 7–8. Extending radially and generally perpendicular to an exterior surface of the input body 172 is a radial tab or offset arm 174 having a pair of opposed ears 176. Additionally, a slot 178 extends through the cylindrical input shaft 172 for mounting a thumb screw or thumb turn as is commonly known in the art.

Figure 9:
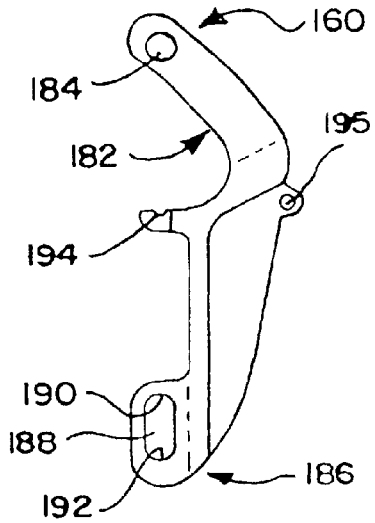
FIG. 9 is a side view of a link arm of the lock actuator.
Figure 10:
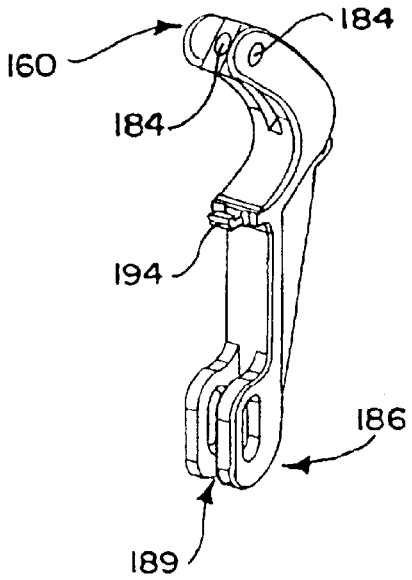
FIG. 10 is an isometric view of the link arm.

The link arm 160, as also seen in FIGS. 9–10, has a first end 180 having a hook 182 integrally formed therein. The first end 180 also has a pair of opposed ear holes 184. A second end 186 of the link arm 160 has a slot or opening 188 having a length and a proximal end 190 and a distal end 192. The second end 186 also includes a spring slit 189. A spring-catch 194 is formed in the link arm 160 and is located in between and generally in line with the oblong slot 188 and the ear holes 184. The link arm 160 also includes a return-spring eyelet 195.

The overcenter spring 162 includes a coil 196, an extended hook 198 at one end and a short hook 200 at another end. The plane defined by the extended hook 198 is generally perpendicular to the plane defined by the short hook 200.

Figure 11:
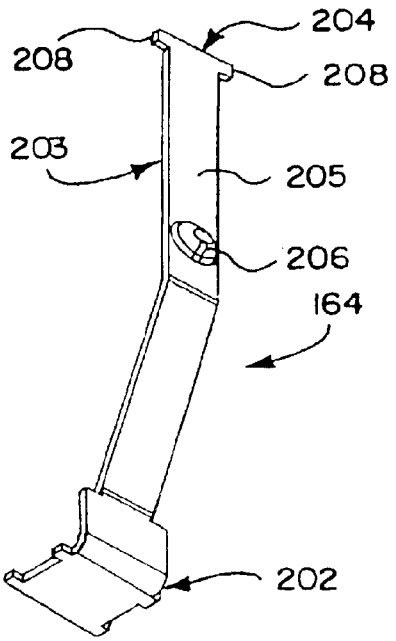
FIG. 11 is an isometric view of an actuation member of the lock actuator.

The actuation member 164 as also seen in FIG. 11 is formed from a flat piece of steel and has a static end 202 and a dynamic or distal end 204. The static end 202 is formed into an L-shape. The dynamic end 204 is generally T-shaped having a pair of opposed protrusions or stop tabs 208 extending therefrom. The actuation member 164 also has an intermediate portion 203 having an exterior surface 205. A dimple 206, is located on the exterior surface 205.

In an assembled state of a preferred embodiment of the lock actuator 50, the housing 156 is mounted to the face plate via case mounts 82. (FIGS. 3–5).

FIGS. 2, 7 and 14–19, show the lock actuator 50 in an assembled state with one side plate 157 removed to more easily depict the internal components of the lock actuator 50. Referring to FIGS. 2 and 7, the shaft 172 of the input device 158 is rotatably mounted to the side plates 157. The ears 176 at the distal end of the offset arm 174 are received by the ear holes 184 to rotatably mount the first end 180 of the link arm 160 to the input device 158.

The link arm pivot pin 212 is received by the slot 188 of the link arm 160. The extended hook 198 is connected to the link arm pivot pin 212 through the spring slit 189. The short hook 200 is attached the spring-catch 194. The overcenter spring 162 thus biases the proximal end 190 of the slot 188 towards the pivot pin 212. Accordingly, the second end 186 of the link arm 160 is slidably and rotatably mounted to the lock member 54. That is, the link arm 160 both rotates about the pivot pin 212 and may slide with respect to the pivot pin 212 such that the pivot pin 212 moves relatively along the length of the slot 188. Additionally, one end of the return spring 165 is connected to the return-spring eyelet 195 and another end of the return spring 165 is connected to a pin 210.

The static end 202 of the actuation member 164 is mounted to the housing 156 such that the exterior surface 205 is located generally adjacent to the aperture 72 of central portion 55, as can be seen in a preferred embodiment depicted in FIGS. 2, 3, and 7. Also, then, the dimple 206 is located at least partially with the aperture 72. It can be seen that the stop tabs 208 of the dynamic end 204 are adapted to engage the safety notches 78. Furthermore, because the actuation member 164 is formed from a flat piece of steel, it is spring like and its dynamic end 204 is biased to an engaged position as shown in FIG. 7.

Figure 12:
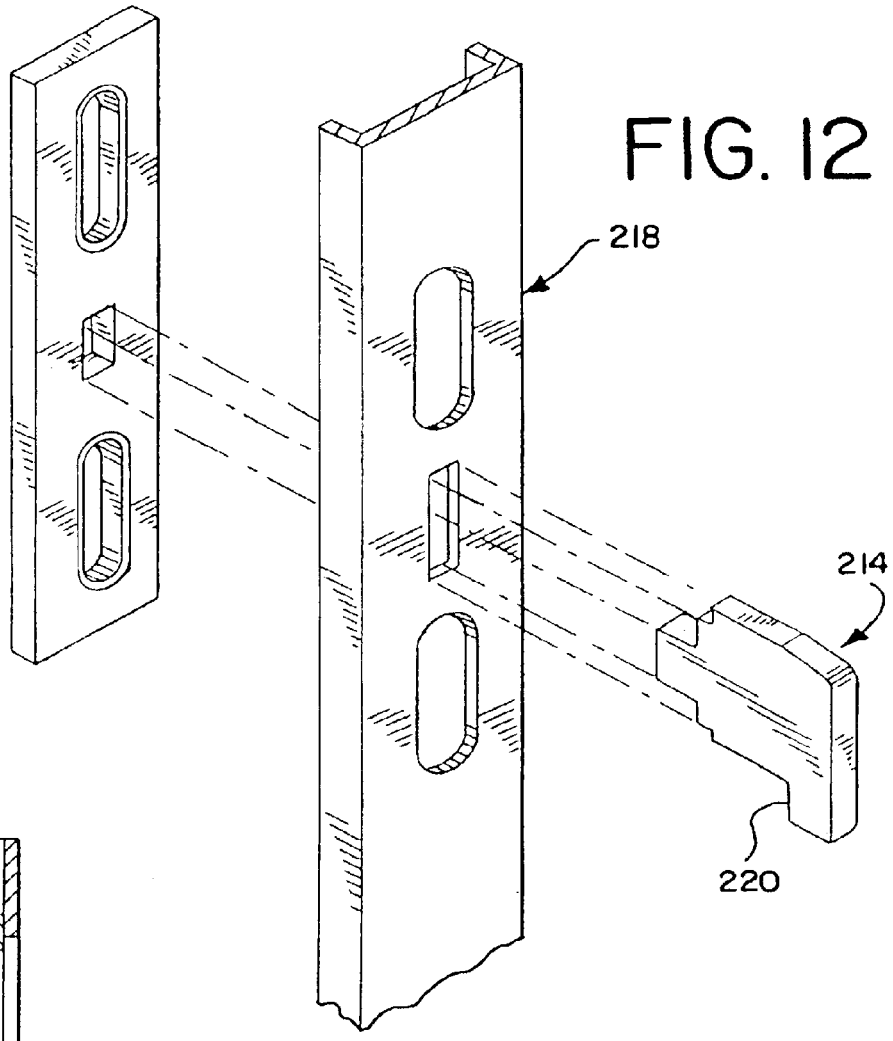
FIG. 12 is a partial exploded view of a strike unit of the lock assembly.
Figure 13:
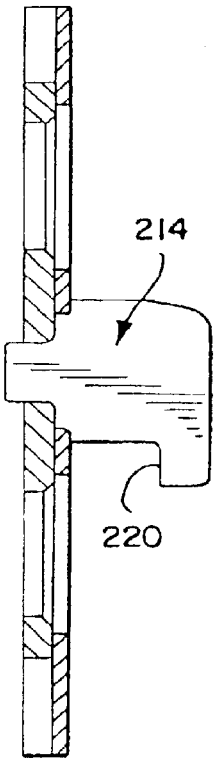
FIG. 13 is a partial side view in cross section of the strike plate assembly.

The strike unit 46 can be seen in FIGS. 2, 12, and 13 and includes latches 214 and a connector bar 218. Each latch 214 defines an engagement surface 220. In a preferred embodiment of the strike unit 46, as shown in FIG. 2, the strike unit 46 includes a centrally located latch 214, an upper latch 214 and a lower latch 214. Each latch 214 is mounted to the connector bar 218 by conventional means known in the art. Each latch 214 is also mounted on the connector bar 218 at a predetermined distance from the other latches 214.

As previously mentioned the sliding lock unit 44 of the lock assembly 42 is installed in the recess 19 of the stile 18. The recess 19 and the sliding lock unit 44 are adapted such that when the sliding lock unit 44 is installed in the recess 18, the exterior surface 53 of the face plate 52 is flush with the edge of the stile 18 and all other components of the sliding lock unit 44 are located within the stile 18 and hidden thereby (FIG. 1). The sliding lock unit 44 may be secured to the stile 18 by any conventional means such as screws or bolts or other known fasteners.

The strike unit 46 is installed into the jamb channel 35 of the left jamb 30. Similar to the sliding lock Unit 44, the strike unit 46 may be secured to the jamb by any conventional means. The jamb channel 35 may be adapted so that the strike hooks 214 do not extend beyond the depth of the jamb channel 35.

The strike unit 46 must be properly aligned with respect to the sliding lock unit 44 before securing the strike unit 46 to the jamb channel 35. The strike unit 44 is properly aligned when each latch 214 is aligned with one of respective apertures 72 or 142 of the lock member assembly 48. Once properly aligned, each latch 214 will be received by its respective aperture 72, or 142, once the sliding panel 12 is slid to a closed position. Because each of the latches 214 are located at a predetermined distance from one another, once one latch 214 is properly aligned, the other latches 214 are also automatically properly aligned with their respective apertures. There is no need to separately align each of the three latches 214.

As depicted in FIG. 7, the input device 158 is in a first position and the central portion 55 is in an unlocked position. This configuration is maintained while the sliding panel 12 is in its open position, by engagement of the safety notches 78 by the stop tabs 208. As the sliding panel 12 is being closed (FIG. 14), the centrally located latch 214 passes into and through the aperture 72. Because of the previously discussed automatic alignment, the upper and lower latches 214 also pass into their respective apertures 142.

As the central strike hook 214 passes into the aperture 72 of the central portion 55, it contacts and engages the dimple 206 of the exterior surface 205. This, in turn, displaces the dynamic end 204 to an un-engaged position disengaging the stop tabs 208 from their respective safety notches 78. This allows sliding movement of the central portion 55. The height of the dimple 206 can vary to fine tune the actuation of the actuation member 164.

Figure 14:
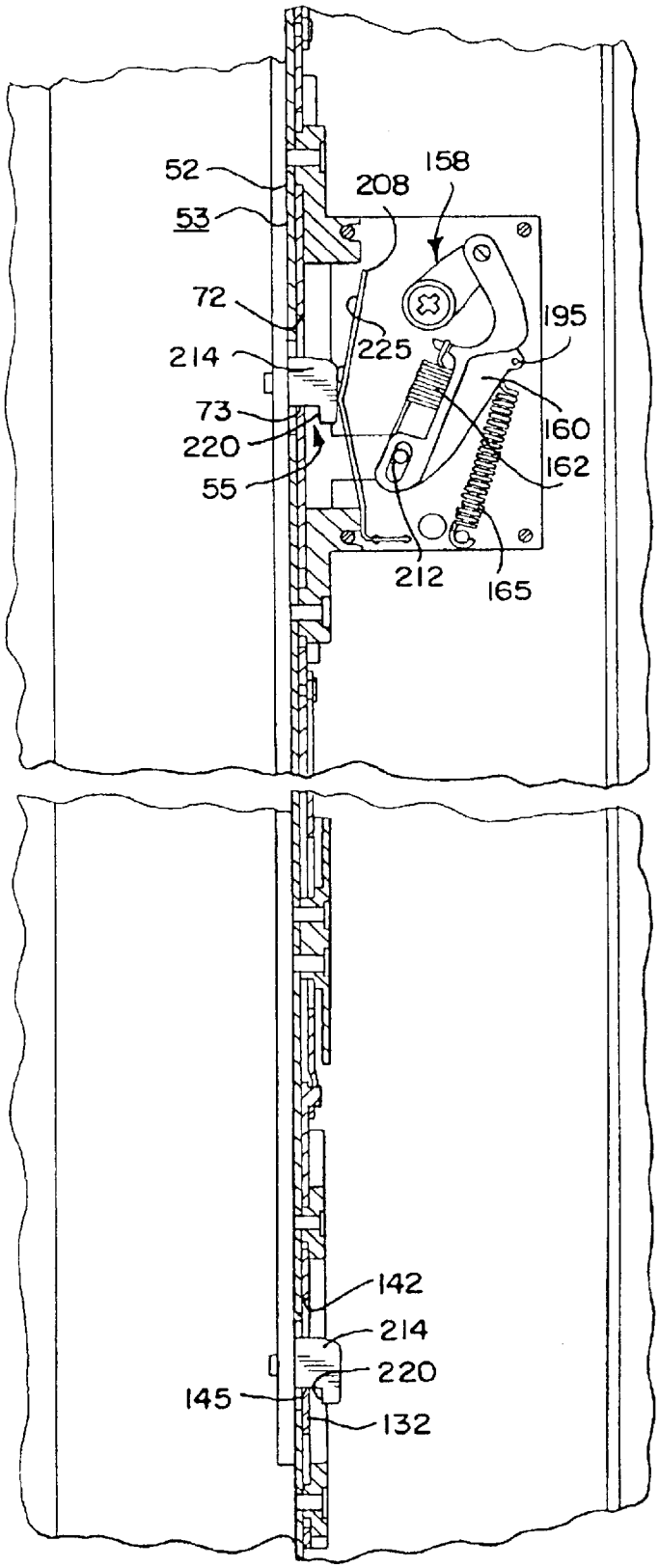
FIG. 14 is a partial side view of the lock assembly showing the input device in an intermediate position.

Once the sliding panel 12 has been fully closed and the safety spring 164 disengaged as described, the input device 158 may be rotated from the first position (FIG. 7) to an intermediate position as shown in FIG. 14. This rotation also moves the center portion 55 from its unlocked position to a locked position wherein the locking surface 73 of the center portion 55 comes into close, interfering abutment with the engagement surface 220 of the central latch 214. Also, the rotation of the input device 158 from the first to intermediate positions results in each extension portion 132 moving from an unlocked position to a locked position wherein its locking surface 145 is in close, interfering abutment with the engagement surface 220 of its respective latch 214. The interference between the locking surfaces 73 and 145, with the engagement surfaces 220 prevents the panel 12 from being slid away from the jamb 30.

Figure 15:
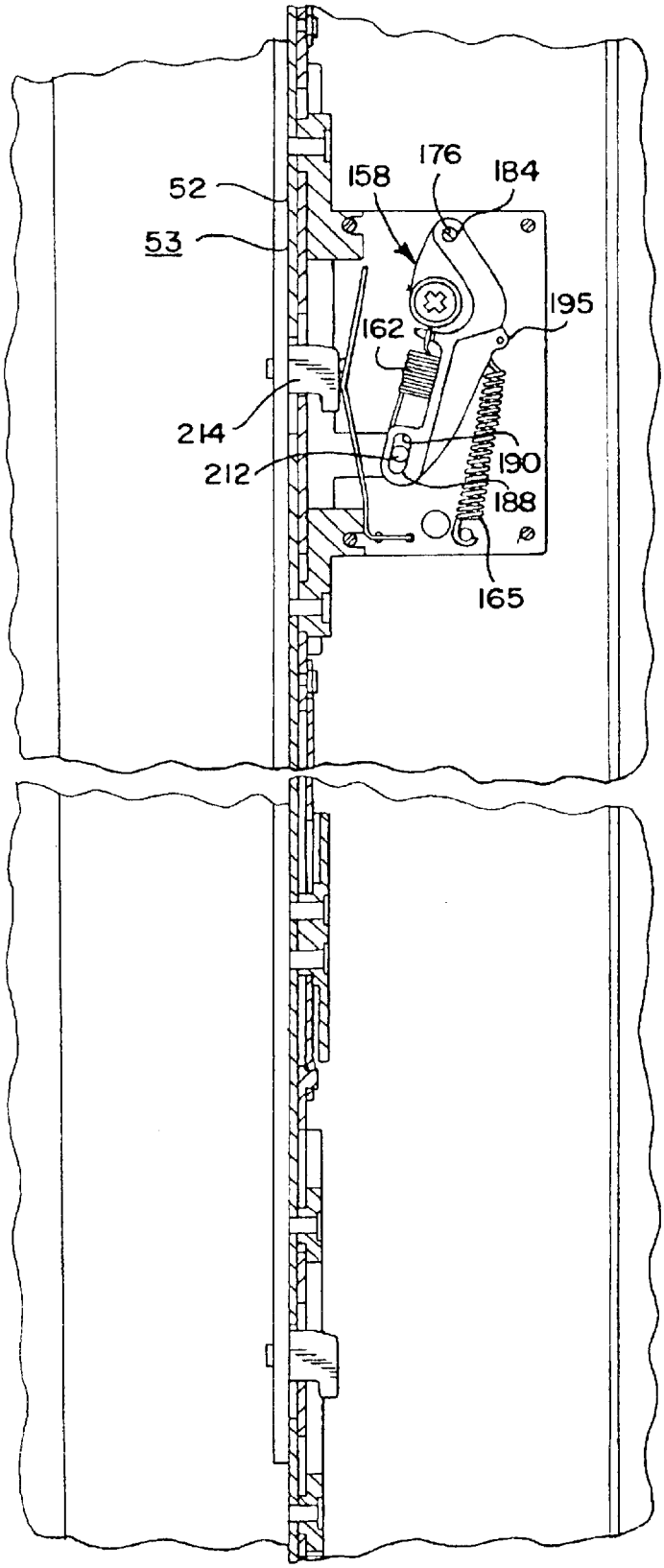
FIG. 15 is a partial side view of the lock assembly showing the input device in an in-line position.
Figure 16:
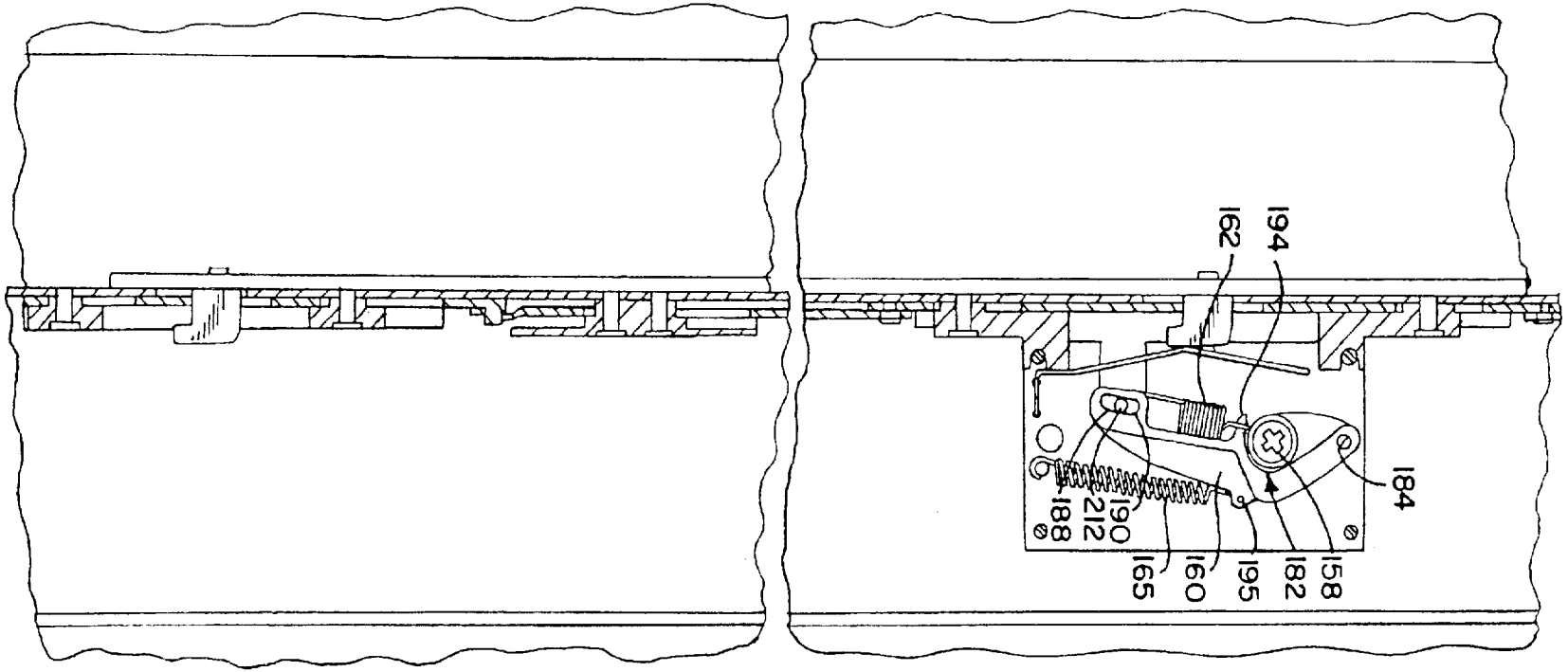
FIG. 16 is a partial side view of the lock assembly showing the input device in an a second or overrotated position.

The input device 158 may then be rotated from the intermediate position shown in FIG. 14, to a second position of overrotation shown in FIG. 16. In doing so, the link arm 160 continues to rotate about the pivot pin 212. Additionally, overcenter spring 162 elastically elongates and the proximal end 190 of the slot 188 moves away from the pivot pin 212, as shown in FIGS. 15 and 16. This provides the necessary radius of rotation to allow the input device 158 to rotate past an in-line position shown in FIG. 15 to the second position shown in FIG. 16. In the second position, the integral hook 182 is biased to receive the input shaft 172 of the input device 158.

To unlock and open the sliding sash 12, the input device 158 is rotated from the second position to the first position. In doing so, the input device 158 passes through the intermediate position and moves the center portion 55 from the locked position to the unlocked position. Once the input device has been rotated to the first position, the sash 12 may be slid away from the jamb 30. It can be understood that the return spring 165 assists in ensuring that the input device 158 is fully returned to the first position of FIG. 7 when unlocking the lock member 54, minimizing the chance for the input device 158 to remain in an intermediate position. Additionally, the return spring 165 provides a desirable feel to the operator while manipulating the input device 158.

Figure 17:
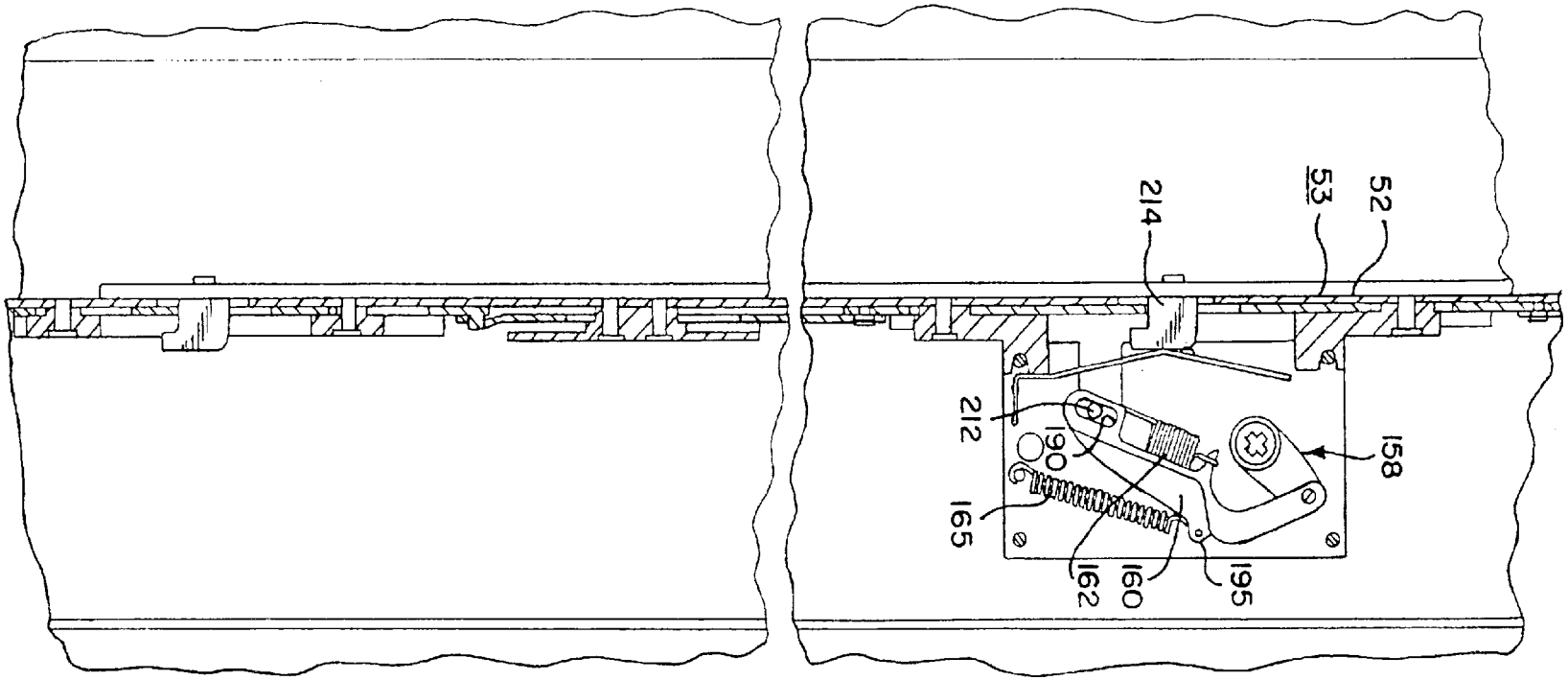
FIG. 17 is a partial side view of the lock assembly showing the input device in a mis-aligned intermediate position.
Figure 18:
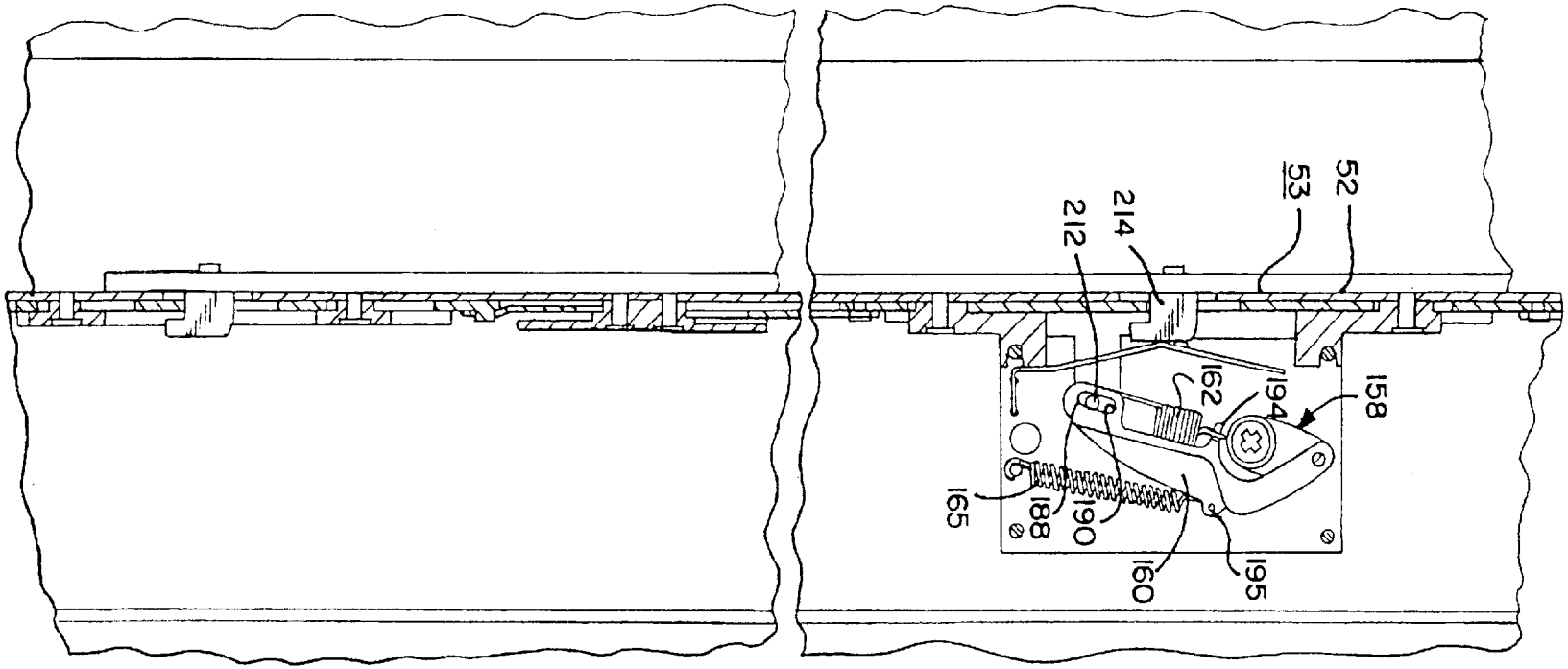
FIG. 18 is a partial side view of the lock assembly showing the input device in a mis-aligned in-line position.
Figure 19:
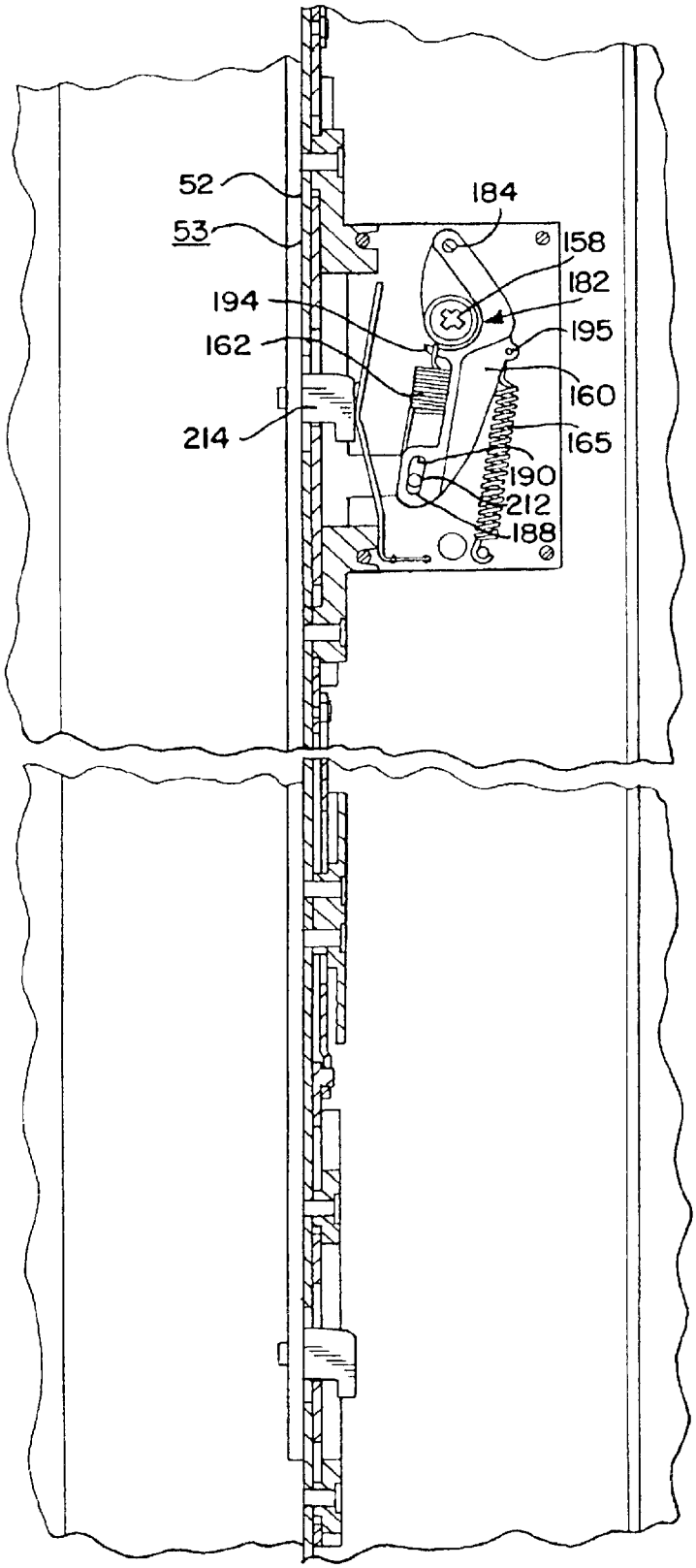
FIG. 19 is a partial side view of the lock assembly showing the input device in a mis-aligned overrotated position.

Overtime, the latches 214 may become slightly misaligned due to shifting of the connector bar 218, or damage to a latch 214 from a variety of potential sources. Or the misalignment may result from an improper initial alignment during installation. This may result, for example, in the central latch 214 passing through the aperture 72 in a position lower than that previously shown and described in FIGS. 14–16, as the sash is slid to its closed position. An example of this misalignment is shown in FIG. 17. In this scenario, rotation of the input device 158 from its first position towards its second position, results in the input device 158 reaching its intermediate position through a smaller angle of rotation than as described and shown above in the scenario where all latches are properly aligned. This misaligned intermediate position of the input device 158 is shown in FIG. 17. The input device 158 may then be rotated through the misaligned intermediate position (FIG. 18) and to its misaligned second position (FIG. 19). In doing so, the proximal end 190 of the slot 188 moves away from pivot pin 212. It can be seen that in the situation of a misaligned latch 214 (FIGS. 17–19), the proximal end 190 moves farther away from the pivot pin 212, than in the situation wherein all the latches 214 are properly aligned, as is previously described and shown in FIGS. 14–16. It can be seen then, that the length of the slot 188, cooperates with the overcenter spring 162 to permit the lock actuator 50 to automatically compensate for a range of misalignment of the latches and to allow the input device 158 to be rotated to an overrotated position.

It is noted at this time that additional embodiments may include a resilient member rather than the link arm as described and remain within the scope of the present invention. Also, the invention can be applied to either sliding or swinging doors or windows. As previously mentioned, it may also be applied to sliding doors or windows that include multiple sliding members.

While the specific embodiments and various details thereof have been illustrated and described, numerous modifications come to mind without significantly departing from the spirit of the invention and the scope of protection is only limited by the following claims.

We claim:

1. A locking system for a moveable member supported by a support frame, the support frame having an engagement surface, the locking system comprising:

an input device adapted to be mounted on the moveable member and rotatable between a first position and a second position, the input device having a shaft;

a link arm having a first end and a second end, the first end having a hook portion and being connected to the input device;

a lock member having a lock surface, the lock member being associated with the link arm; and a spring having one end connected to the link arm and another end connected to the lock member;

wherein the link arm and spring move the lock member in response to rotational movement of the input device from the first position to an intermediate position wherein the lock member moves from an unlocked position to a locked position wherein the lock surface is configured to contact the engagement surface, and wherein the operable connection between the link arm and lock member allows the link arm to move relative to the lock member without any further locking movement of the lock member to allow further rotation of the input device to the second position wherein the hook receives the shaft.

2. The system of claim 1 wherein the moveable member is a door and the support frame is a door frame.

3. The system of claim 1 wherein the moveable member is a window and the support frame is a window frame.

4. The system of claim 1 wherein the second end of the link arm has a slot therein and the locking member has a pin being received by the slot.

5. The system of claim 4 wherein the second end of the spring is connected to the pin.

6. The system of claim 1 further comprising:

a latch mounted to the door frame defining the engagement surface; and an aperture defining the lock surface;

wherein the aperture receives the latch.

7. The system of claim 6 further comprising:

an actuation member having a dynamic end wherein the dynamic end is moveable between an engaged position and an un-engaged position wherein the engaged position, the actuation member prevents movement of the lock member from the unlocked position and where in the un-engaged position, the actuation member permits movement of the lock member from the locked position, and a dimple protruding from the actuation member adapted to be engaged by the latch as it is received by the aperture.

8. The system of claim 1 further comprising:

an upper extension operably connected to the lock member, the upper extension having an upper lock surface;

wherein the link arm and spring move the upper extension in response to rotational movement of the input device from the first position to the intermediate position wherein the upper lock surface contacts an upper engagement surface of the door frame.

9. The system of claim 8 wherein the operable connection between the link arm and lock member allows the link arm to move relative to the lock member to inflow the input device to be further rotated to the second position after the upper lock surface contacts the upper engagement surface.

10. The system of claim 8 further comprising:

an upper latch mounted to the door frame defining the upper engagement surface;

and an upper aperture defining the upper lock surface;

wherein the upper aperture receives the upper latch.

11. The system of claim 8 further comprising:

a lower extension operably connected to the lock member, the lower extension having a lower lock surface;

wherein the link arm and spring move the lower extension in response to rotational movement of the input device from the first position to the intermediate position wherein the lower lock surface contacts a lower engagement surface of the door frame.

12. The system of claim 11 wherein the operable connection between the link arm and lock member allows the link arm to move relative to the lock member to allow the input device to be further rotated to the second position after the lower lock surface contacts the lower engagement surface.

13. The system of claim 8 further comprising:

a lower latch mounted to the door frame defining the lower engagement surface; and a lower aperture defining the lower lock surface;

wherein the lower aperture receives the latch.

14. The system of claim 1 further comprising:

an actuation member having a dynamic end wherein the dynamic end is moveable between an engaged position and an un-engaged position wherein the engaged position, the actuation member prevents movement of the lock member from the unlocked position and where in the un-engaged position, the actuation member permits movement of the lock member from the locked position.

15. A locking system for a door movably mounted in a door frame, the door frame having an engagement surface, the locking system comprising:

an input device adapted to be mounted on the door and rotatable from a first position to a second position, the input device having a shaft;

a link arm having a first end and a second end, the first end having a hook and being connected to the input device;

a lock member having a lock surface, the lock member being associated with the link arm; and a spring having a first end connected to the link arm and a second end connected to the lock member;

wherein the link arm and spring move the lock member in response to rotational movement of the input device from the first position to an intermediate position wherein the lock member moves from an unlocked position to a locked position wherein the lock surface is configured to contact the engagement surface, and wherein the operable connection between the link arm and lock member allows the link arm to move relative to the lock member without any further locking movement of the lock member to allow the input device to be further rotated to the second position wherein the shaft is received by the hook of the link arm.

16. The system of claim 15 wherein the second end of the link arm has a slot therein and the locking member has a pin being received by the slot.

17. The system of claim 16 wherein the second end of the spring is connected to the pin.

18. The system of claim 15 further comprising:

a latch mounted to the door frame defining the engagement surface; and an aperture defining the lock surface;

wherein the aperture receives the latch.

19. The system of claim 15 further comprising:

an upper extension operably connected to the lock member, the upper extension having an upper lock surface;

wherein the link arm and spring move the upper extension in response to rotational movement of the input device from the first position to the intermediate position wherein the upper lock surface contacts an upper engagement surface of the door frame.

20. The system of claim 19 wherein the operable connection between the link arm and lock member allows the link arm to move relative to the lock member to allow the input device to be further rotated to the second position after the upper lock surface contacts the upper engagement surface.

21. The system of claim 19 further comprising:

an upper latch mounted to the door frame defining the upper engagement surface; and an upper aperture defining the upper lock surface;

wherein the upper aperture receives the upper latch.

22. The system of claim 15 further comprising:

a lower extension operably connected to the lock member, the lower extension having a lower lock surface;

wherein the link arm and spring move the lower extension in response to rotational movement of the input device from the first position to the intermediate position wherein the lower lock surface contacts a lower engagement surface of the door frame.

23. The system of claim 22 wherein the operable connection between the link arm and lock member allows the link arm to move relative to the lock member to allow the input device to be further rotated to the second position after the lower lock surface contacts the lower engagement surface.

24. The system of claim 22 further comprising:

a lower latch mounted to the door frame defining the lower engagement surface; and a lower aperture defining the lower lock surface;

wherein in the lower aperture receives the latch.

25. The system of claim 15 wherein the lock member has u-shaped cross section.

26. A locking system for a door movably mounted in a door frame, the door frame having a tab having an engagement surface, the locking system comprising:

an input device adapted to be rotatably mounted in the door from an unlocked position to a locked position;

a link arm having a first end and a second end, the first end being connected to the input device, the second end having a slot therein;

a lock member having an aperture defining a lock surface, the lock member having a pin positioned in the slot of the second end of the link arm;

a spring having one end connected to the link arm and another end connected to tho pin;

wherein the link arm and spring move the lock member in response to rotational movement of the input device from the unlocked position to an intermediate position wherein the lock member moves from an unlocked position to a locked position wherein the aperture is adapted to receive the tab wherein the lock surface is adapted to contact the engagement surface, the pin being allowed to slide in the slot of the link arm to allow further rotation of the input device and link arm without any further locking movement of the lock member wherein the input shaft can be further rotated from the intermediate position to the locked position when the lock member is in the locked position.

27. A locking system for a door movably mounted in a support frame, the support frame having an engagement surface, the locking system comprising:

an input device having a shaft and configured to be mounted on the door for rotation between a first position and a second position;

a link arm having a first end and a second end, the first end having a hook portion and being connected to the input device;

a lock member having a lock surface, the lock member being associated with the link arm;

a spring having one end connected to the link arm and another end connected to the lock member; and, an actuation member moveable between an engaged position wherein the actuation member prevents substantial movement of the lock member and a disengaged position wherein the actuation member permits movement of the lock member;

wherein the link arm and spring move the lock member in response to rotational movement of the input device from the first position to an intermediate position wherein the lock member moves from an unlocked position to a locked position wherein the lock surface is configured to contact the engagement surface, and wherein the operable connection between the link arm and lock member allows the link arm to move relative to the lock member to allow further rotation of the input device to the second position wherein the hook receives the shaft.

28. The system of claim 27 wherein the actuation member has a pair of laterally opposed protrusions adapted to engage the lock member.

* * * * *